US006008784A

United States Patent [19]

Acres et al.

[11] Patent Number: 6,008,784

[45] Date of Patent: Dec. 28, 1999

[54] ELECTRONIC DISPLAY WITH CURVED FACE

[75] Inventors: John F. Acres; Bryan Quian, both of Corvallis, Oreg.

[73] Assignee: Acres Gaming Incorporated, Corvallis, Oreg.

[21] Appl. No.: 08/744,516

[22] Filed: Nov. 6, 1996

[51] Int. Cl.[6] ..... G09G 3/32

[52] U.S. Cl. ..... 345/82; 345/55

[58] Field of Search ..... 345/82, 55, 75, 345/92, 156, 173, 175, 76; 385/147; 313/511, 422, 497, 501; 324/161; 362/27, 23, 241, 30; 315/169.3, 169.4

[56] References Cited

U.S. PATENT DOCUMENTS

| | | | |
|---|---|---|---|
| 4,472,775 | 9/1984 | Mizuno et al. | 324/161 |
| 4,567,480 | 1/1986 | Blanchard | 345/175 |
| 4,689,604 | 8/1987 | Sokol | 345/82 |
| 4,734,623 | 3/1988 | Ohkoshi et al. | 345/75 |
| 4,891,508 | 1/1990 | Campbell | 345/175 |
| 5,162,696 | 11/1992 | Goodrich | 313/511 |
| 5,226,723 | 7/1993 | Chen | 362/241 |
| 5,596,671 | 1/1997 | Rockwell, III | 385/147 |
| 5,604,394 | 2/1997 | Saito et al. | 313/422 |
| 5,741,058 | 4/1998 | Suzuki et al. | 362/27 |
| 5,747,928 | 5/1998 | Shanks et al. | 345/76 |

*Primary Examiner*—Chanh Nguyen
*Assistant Examiner*—John Suraci
*Attorney, Agent, or Firm*—Marger Johnson & McCollom, P.C.

[57] ABSTRACT

An electronic display includes a plurality of electronically controlled display elements arranged to form a face which is curved around a horizontal axis. The display elements are mounted on display sections which are aligned along a common axis and fastened side-by-side to a chassis to create a display having a desired length. Each display section includes a frame having semi-circular sides which define a radius around the axis and a flexible printed circuit board which is curved around the radius and fastened to the frame. The display elements are preferably light emitting diodes which are fabricated in arrays and mounted to the printed circuit board with sockets. The light emitting diodes are electrically coupled through the printed circuit board to a display driver such as a programmable controller which selectively illuminates the display elements to form images on the curved face of the display.

5 Claims, 4 Drawing Sheets

ELECTRONIC DISPLAY WITH CURVED FACE

BACKGROUND OF THE INVENTION

1. Field of the Invention

This invention relates generally to electronic displays and more particularly to an electronic display having a curved face.

2. Description of the Related Art

Electronic displays are used in casino gaming operations to display information such as special promotional bonus jackpot values. Such displays typically employ a flat array of light emitting diodes (LEDs) which are selectively illuminated to display numbers or other information. For example, a flat display panel may be used to display a number representing the value of a bonus jackpot which is continuously being incremented. Displays have also been used in a "race track" configuration in which several LED panels are mounted end-to-end around the top of a table or kiosk with the LEDs facing outwardly. The LEDs are selectively illuminated to scroll information around the outer periphery. The LEDs are arranged as a flat vertical panel along the sidewalls of the table or kiosk. To round the corners, the LEDs are arranged to form a face which is curved around a vertical axis.

A problem with flat displays, however, is that they may not attract a great deal of attention. In order to encourage participation in special promotions, a casino operator needs to attract as much attention as possible to bonus jackpots and other incentives.

Accordingly, a need remains for a technique for attracting attention to an electronic display.

SUMMARY OF THE INVENTION

It is, therefore, an object of the invention to improve the visual impact of an electronic display.

Another object of the invention is to provide an electronic display which draws increased attention to the information it is displaying, without requiring a large expenditure of capital to manufacture.

To achieve these and other objects, an electronic display in accordance with the present invention includes a plurality of electronic display elements, such as light emitting diodes (LEDs), arranged to form a face which is curved around a horizontal axis. A display drive circuit is coupled to the elements to display a visual image on the face of the display. The LEDs are preferably mounted in LED arrays which are plugged into sockets on a PC board. The PC board is curved around a horizontal axis and attached to a frame to maintain it in the curved position, thereby forming a display section. Several display sections can be placed side-by-side with their axes aligned along a common line. The sections can then be attached to a chassis to form a display having any desired length.

An advantage of the present invention is that it adds visual interest and draws attention to an electronic display.

Another advantage of the present invention is that it can be fabricated using existing display PC boards, thereby reducing the start-up costs associated with designing and fabricating a display.

The foregoing and other objects, features and advantages of the invention will become more readily apparent from the following detailed description of a preferred embodiment of the invention which proceeds with reference to the accompanying drawings.

DETAILED DESCRIPTION

Figures 1, 3:
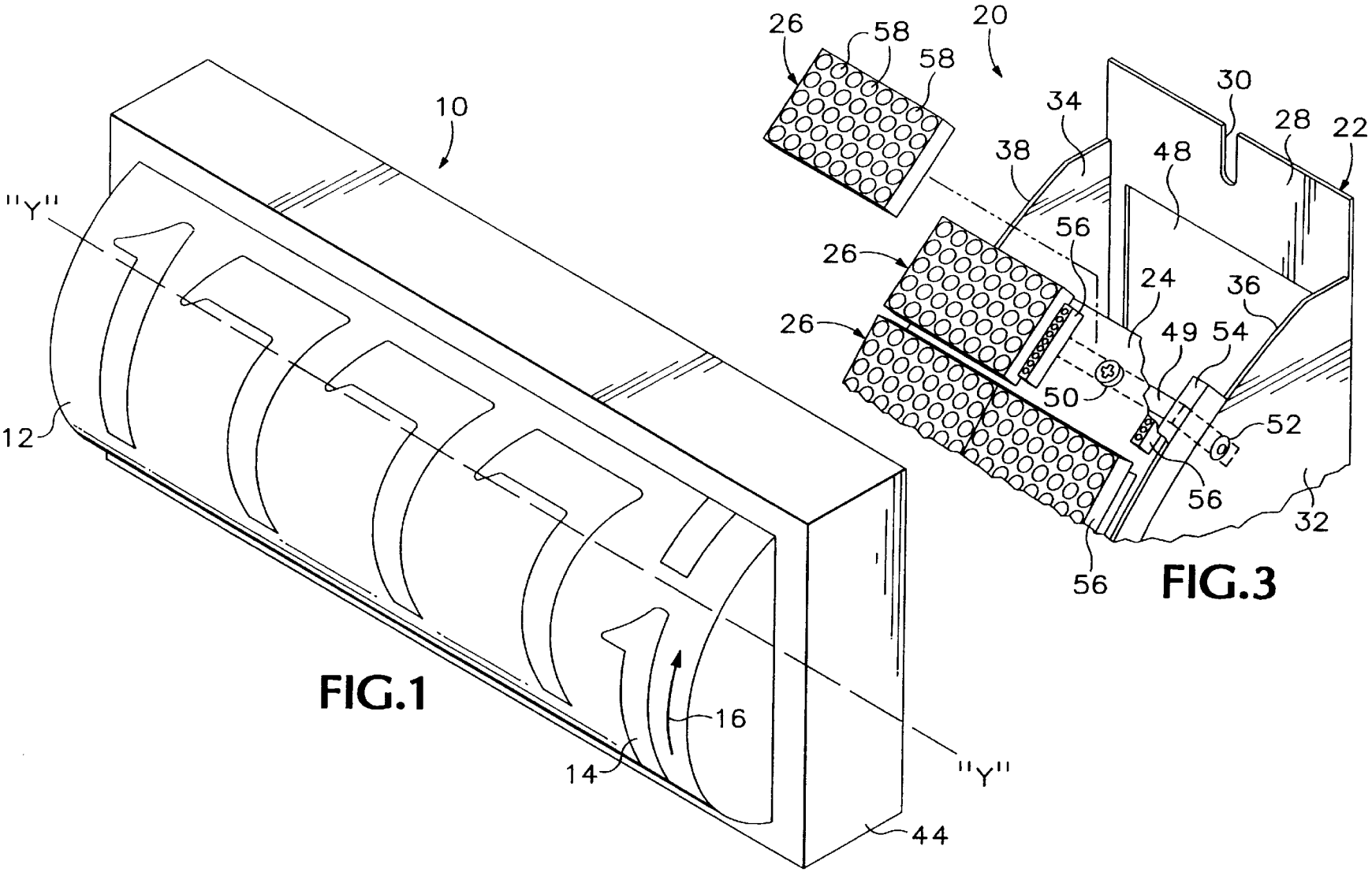
FIG. 1 is a perspective view of an electronic display having a curved face in accordance with the present invention.
FIG. 3 is a partial exploded and cut-away view showing more detail of a display section of FIG. 2.

Indicated generally at 10 in FIG. 1 is an embodiment of an electronic display having a face which is curved along a horizontal axis in accordance with the present invention. Prior to describing the detailed structure of the display 10, the key components of the display will be identified followed by a description of the operation of the system. Then a more detailed description of each of the components will be provided.

Referring to FIG. 1, the display includes numerous light emitting diodes (LEDs) or other electronically controllable display elements arranged to form a curved face 12, which is curved around a horizontal axis Y—Y. The LEDs are connected to a display drive circuit which selectively illuminates the LEDs to form a visual image on the face of the display. The drive circuit can be a programmable controller which is programed to selectively illuminate the LEDs to display a series of numerals. By properly programming the controller, a numeral or other character such as 14 can be made to appear to scroll circumferentially along the face of the display as shown by the arrow 16. Thus, the entire display takes on the overall appearance of a mechanical odometer, while maintaining the benefits an electronic display. By utilizing LEDs which emit light of more then one color, the individual numerals can be illuminated with different colors, thereby increasing the visual impact of the display.

Figure 2:
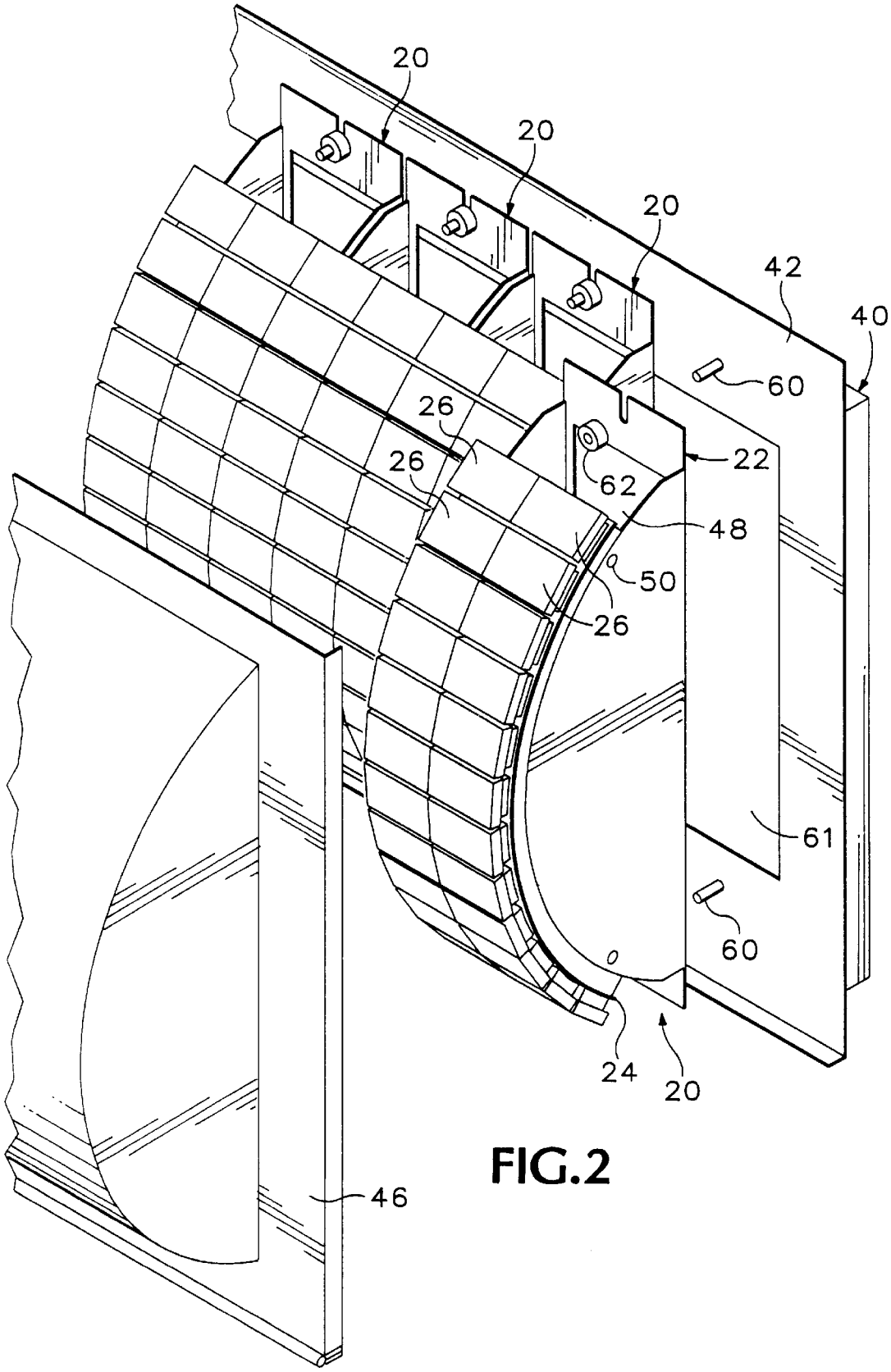
FIG. 2 is a partial exploded view showing more detail of the display of FIG. 1.

More detailed consideration will now be given to the structure of the display 10 of the present invention. Referring to FIG. 2, a display constructed in accordance with the present invention comprises one or more display sections 20. Each display section 20 includes a frame 22 and a mounting board 24 having a curved surface which is curved around a horizontal axis. A plurality of LED arrays 26 are mounted to the mounting board with the LEDs facing radially outward from the axis, thereby forming a display having a curved face.

The display section 20 is mounted on a folded metal chassis 40 which has a flat front panel 42. Numerous display sections 20 can be mounted side by side as shown in FIG. 2 to accommodate the amount of information or size of characters that are to be displayed. The chassis 40 is mounted on a wood or metal housing 44 as shown in FIG. 1, and covered with a transparent cover 46 as best seen in FIG. 2. The transparent cover is preferably made of an impact resistant polymer which may be tinted or otherwise treated to enhance contrast.

Referring now to FIG. 3, the frame 22 of each display section 20 includes a flat, rectangular, vertically oriented base plate 28 and two parallel, vertical, semicircular frame members 32 and 34 extending perpendicularly from the base plate. Each frame member 32 and 34 has a curved edge 36 and 38, respectively, which defines a radius about a horizontal axis which is parallel to the base plate. The base plate 28 includes an opening 48 to allow access to the back of printed circuit board 24 for wiring, and a pair of slots 30 located along the top and bottom edges of the base plate to facilitate mounting the display section to the chassis 40 as shown in FIG. 2. The frame 22 is preferably fabricated from a single sheet of light gage, folded sheet metal.

Referring again to FIG. 3, the mounting board 24 is preferably a printed circuit (PC) board and is attached to the frame adjacent the curved edges 36 and 38 of frame members 32 and 34 so as to maintain the board in a curved position along the radius defined by the curved edges. The PC board is attached to the frame members 32 and 34 with a bracket 49 at each end. The PC board is attached to the brackets with screws 50, while the brackets are attached to the frame members with rivets 52. A strip of insulating material 54 such as nonconductive foam is compression fit between the printed circuit board 24 and each of the frame members 32 and 34 to insulate the printed circuit board from the frame.

Each display section 20 includes one or more circumferential rows of commercially available LED arrays 26. Each array has a plurality of LED segments 58 and is mounted to the PC board 24 with one or more sockets or headers 56, which electrically couple the LED array 26 to the printed circuit board. One or more electrical connectors (not shown) are mounted to the back of the printed circuit board for connecting the printed circuit board to a display driver, such as a programmable controller, through an electrical cable.

The printed circuit board 24 and LED arrays 26 make up a PC board assembly which is similar to those used in conventional flat displays. Thus, the design and manufacturing costs of a curved face electrical display in accordance with the present invention are minimized because the display sections 20 of the present invention can be manufactured using "off the shelf" PC board assemblies if the printed circuit boards are thin enough to bend at the required radius (7.85 inches in a preferred embodiment). Otherwise, the only change required to adapt an "off the shelf" PC board assembly to the present invention is to fabricate it using a relatively thin and flexible printed circuit board material.

Referring to FIG. 2, the display sections 20 are assembled to the chassis 40 by aligning the slots 30 on the base plate of the frame with pegs 60 which protrude from the front panel 42 of the chassis 40. The display section 20 is then secured in place with any suitable fasteners 62.

An advantage of the display sections 20 is that they produce a modular design, wherein a malfunctioning section can be replaced without having to replace the entire display. Likewise, individual LED arrays 26 can be replaced without having to remove the entire display section 20.

The individual LEDs in the display face are coupled to the display drive circuit with an electrical cable (not shown) which passes through opening 48 in the base plate of frame 22 and through opening 61 in the front panel 42 of the chassis. The cable is connected to one or more connectors on the back of the printed circuit board assembly which in turn is connected to the LED arrays 26 through connectors 56 and through traces on the printed circuit board. The cable is connected to a programmable controller which is located within the housing 44 of FIG. 1.

Figure 4:
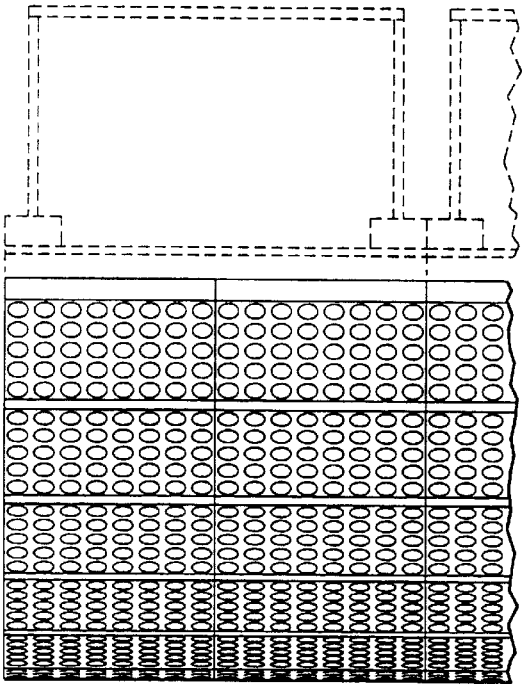
FIG. 4 is a top plan view of an electronic display in accordance with the present invention.
Figure 5:
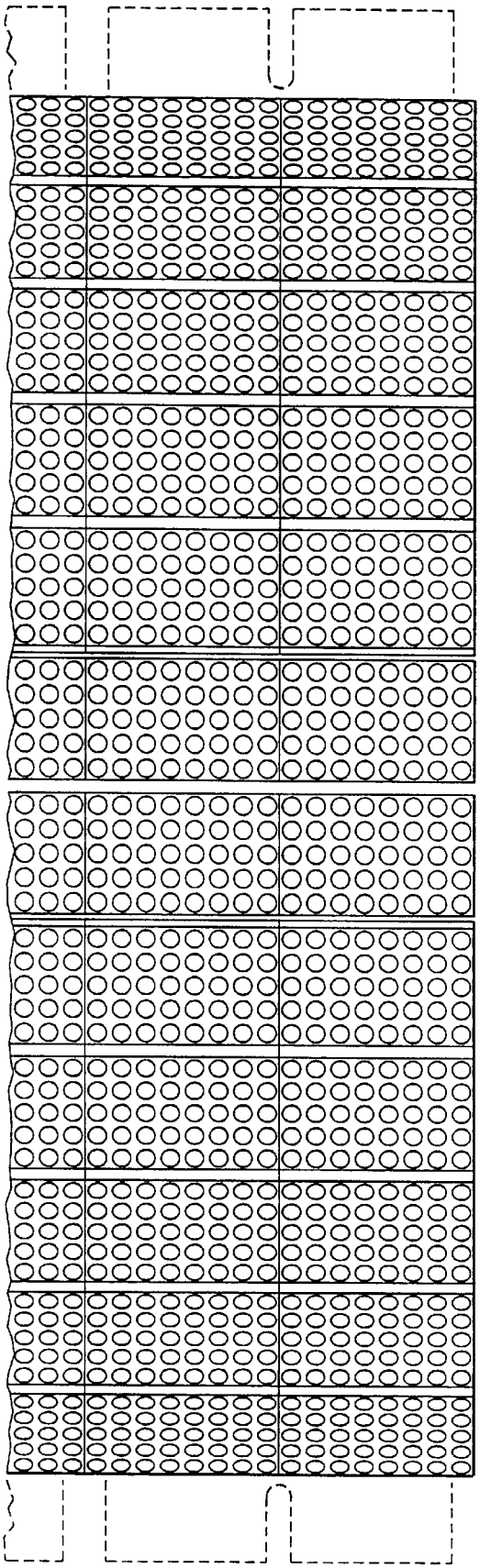
FIG. 5 is a front elevational view of an electronic display in accordance with the present invention.
Figure 6:
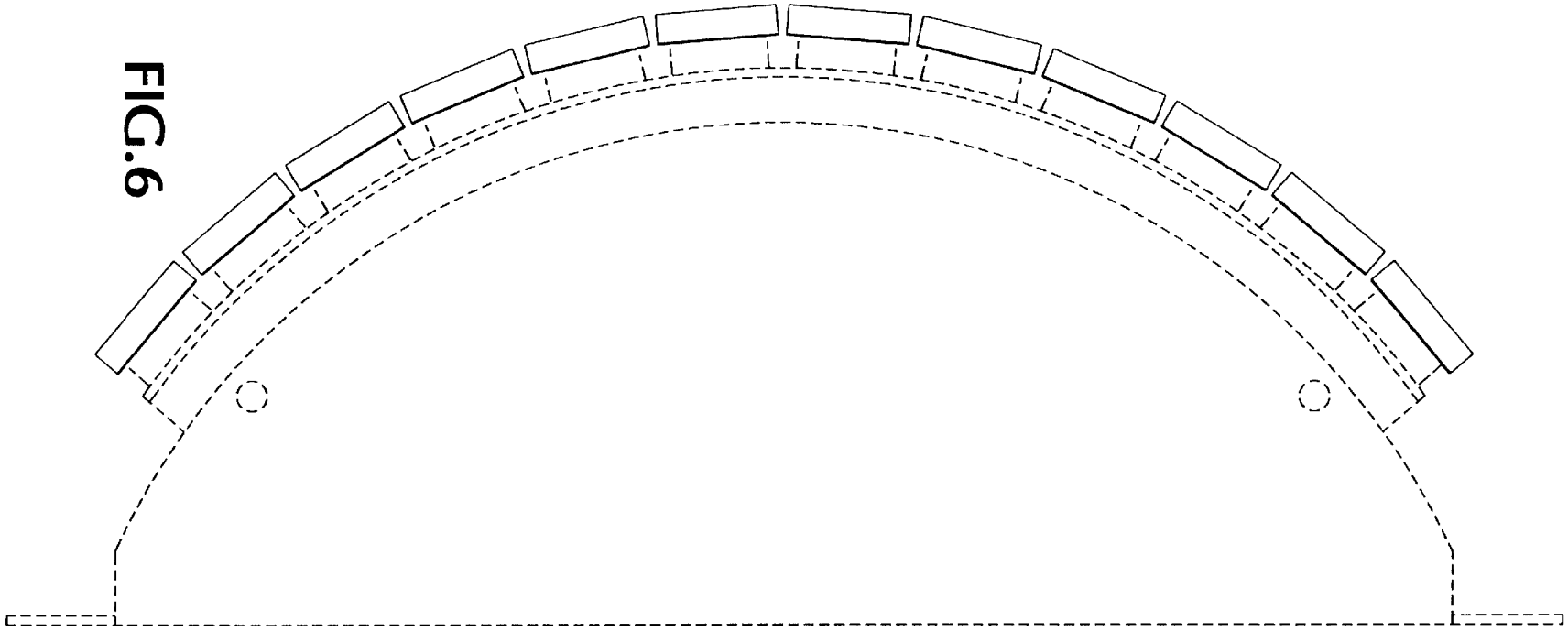
FIG. 6 is a side elevational view of an electronic display in accordance with the present invention.

The overall appearance of an electronic display in accordance with the present invention can be seen in FIGS. 4, 5, and 6 which show top plan, front elevational, and side elevational views, respectively.

Having described and illustrated the principles of the invention in a preferred embodiment thereof, it should be apparent that the invention can be modified in arrangement and detail without departing from such principles. I claim all modifications and variations coming within the spirit and scope of the following claims.

We claim:

1. An electronic display comprising:

a plurality of electronically controllable display elements arranged to form a face which is curved around a horizontal axis;

a mounting board having a surface which is curved around the horizontal axis, the plurality of display elements being mounted to the mounting board; and a frame attached to the mounting board to maintain the mounting board in a curved position;

wherein the frame includes:

a base plate oriented parallel to the horizontal axis; and two parallel frame members extending perpendicularly from the base plate, each frame member having a curved edge defining a radius from the horizontal axis;

the mounting board being attached to the frame adjacent the curved edges of the frame members so as to maintain the mounting board in a curved position along the radius defined by the curved edges.

2. An electronic display according to claim 1 further including a piece of electrically insulating material disposed between the mounting board and the frame.

3. An electronic display comprising:

a plurality of electronically controllable display elements arranged to form a face which is curved around a horizontal axis;

a plurality of mounting boards, each mounting board having a surface which is curved around the horizontal axis, the plurality of display elements being mounted to the mounting boards;

a plurality of frames, each frame attached to a respective one of the mounting boards to maintain the mounting board in a curved position; and a chassis, the plurality of frames being removably attached to the chassis;

wherein each frame includes:

a base plate oriented parallel to the horizontal axis; and two parallel frame members extending perpendicularly from the base plate, each frame member having a curved edge defining a radius from the horizontal axis;

each mounting board being attached to one of the plurality of frames adjacent the curved edges of the frame members so as to maintain the mounting board in a curved position along the radius defined by the curved edges.

4. An electronic display according to claim 3 wherein the chassis includes a face plate, the base plate of each of the plurality of frames being attached to the face plate of the chassis to align all of the mounting boards along a common axis.

5. An electronic display comprising:

a plurality of electronically controllable display elements; and means for supporting the plurality of display elements to form a curved face having a horizontal axis;

wherein the means for supporting the plurality of display elements includes a mounting board having a surface which is curved around the horizontal axis, and a frame attached to the mounting board to maintain the mounting board in a curved position; and wherein the frame includes:

a base plate oriented parallel to the horizontal axis; and two parallel frame members extending perpendicularly from the base plate, each frame member having a curved edge defining a radius from the horizontal axis;

the mounting board being attached to the frame adjacent the curved edges of the frame members so as to maintain the mounting board in a curved position along the radius defined by the curved edges.

* * * * *